United States Patent [19]

Fehrer

[11] Patent Number: 4,972,551

[45] Date of Patent: Nov. 27, 1990

[54] APPARATUS FOR MAKING A NON-WOVEN FABRIC

[76] Inventor: Ernst Fehrer, Auf der Gugl 28, A-4020 Linz, Austria

[21] Appl. No.: 490,094

[22] Filed: Mar. 7, 1990

[30] Foreign Application Priority Data

Mar. 21, 1989 [AT] Austria ..... 650/89

[51] Int. Cl.[5] ..... D01G 15/26

[52] U.S. Cl. ..... 19/99; 19/145.7; 19/302

[58] Field of Search ..... 19/99–101, 19/302, 303, 304, 145.7

[56] References Cited

U.S. PATENT DOCUMENTS

| | | | |
|---|---|---|---|
| 3,058,169 | 10/1962 | Joa | 19/303 |
| 4,130,915 | 12/1978 | Gotchel et al. | 19/304 |
| 4,475,271 | 10/1984 | Lovgren et al. | 19/105 |
| 4,534,086 | 8/1985 | Fehrer | 19/99 |
| 4,583,267 | 4/1986 | Fehrer | 19/99 |
| 4,637,104 | 1/1987 | Mante | 28/283 |
| 4,833,758 | 5/1989 | Sano et al. | 19/304 |

*Primary Examiner*—W. C. Reynolds
*Assistant Examiner*—John J. Calvert
*Attorney, Agent, or Firm*—Kurt Kelman

[57] ABSTRACT

An apparatus for making a non-woven fabric comprises a plurality of tooth-carrying carding drums, which rotate in the same sense and succeed each other in the direction of travel of the preliminary web. Each carding drum which succeeds another in the direction of travel of the preliminary web constitutes a worker roller for the next preceding carding drum. The fibers flow off from the carding drums in discharge ducts and are deposited on a collecting surface, to which suction is applied. In order to ensure a uniform deposition of the fibers on the collecting surface, each discharge passage is provided adjacent to its boundary walls with an air inlet opening, which extends throughout the width of the collecting surface and is constituted by an air-entraining injector nozzle, which is directed toward the collecting surface and discharges an air stream which is parallel to the boundary wall.

2 Claims, 2 Drawing Sheets

APPARATUS FOR MAKING A NON-WOVEN FABRIC

BACKGROUND OF THE INVENTION

1. Field of the Invention

This invention relates to an apparatus for making a non-woven fabric, comprising carding drums, which are provided with teeth and rotate in the same sense and closely succeed each other in the direction of travel of a preliminary web, wherein each of said carding drums which succeeds another in the direction of travel of the preliminary web cooperates as a worker roller with the preceding carding drum, discharge ducts are provided, which extend into respective generally triangular spaces between adjacent carding drums and at least adjacent to one of their two boundary walls extending in the longitudinal direction of the adjacent drums are formed with at least one air inlet opening, which extends over the length of said wall, and a continuously moved, air-permeable collecting surface is provided, to which suction is applied adjacent to each discharge duct and which serves to collect those fibers of the preliminary web which have been thrown off from the carding drums under the action of centrifugal force.

2. Description of the Prior Art

Apparatuses of that kind are known from Austrian Patent Specification No. 348,830. In said apparatuses, the carding drums are arranged in close succession, each succeeding carding drum can comb out like a worker roller fibrous material from the preceding carding drum and those fibers which have not been combed out will be thrown off onto the collecting surface immediately after the combing operation. This will result in an excellent disintegration of the preliminary web and it is possible to divide the preliminary web in a simple manner into a plurality of partial streams of fibers because each succeeding carding drum performs an additional combing operation, which provides fibrous material for at least one additional partial stream. As a result, the partial stream of fibers flying from each carding drum may have a low fiber density even though the throughput rate of material moving through the apparatus is comparatively high. In combination with an application of fibers in a plurality of layers, that low fiber density is a requirement for the making of a non-woven fabric which is highly uniform. But such a highly uniform non-woven fabric cannot be achieved unless an undisturbed and uniform deposition of the fibers on the collecting surface is ensured. To provide a suitable air flow for entraining the fibers, air inlet openings are required at the discharge ducts. It has been found, however, that such air inlet openings are less desirable than blast nozzles, which are provided on that side of the carding drums which is opposite to the collecting surface, as is proposed in Austrian Patent Specification No. 379,619 and the corresponding U.S. Pat. No. 4,534,086. This is so because the air which is discharged by said blast nozzles flows through the throats between adjacent carding drums and can be controlled to ensure that the air streams in the discharge ducts will match the velocity at which the fibers are thrown off and said air will assist the separation of the fibers from the carding drums. But as the working width increases, the diameters of the carding drums and, as a result, the flight distances of said fibers, are increased and the increasing flight distance of the fibers will promote an agglomeration of fibers. For this reason, larger working widths will adversely affect the uniform delivery of fibers to the collecting surface, particularly adjacent to those boundary walls of the discharge ducts which extend along the carding drums. Such disturbances must particularly be expected because an electrostatic charging of the fibers adjacent to said boundary walls may cause the fibers to deposit on the boundary walls.

SUMMARY OF THE INVENTION

It is an object of the invention to ensure by the use of simple means that the fibers which have been thrown off from the carding drums will be deposited on the collecting surface with a high uniformity even if the drums are relatively large in diameter.

In an apparatus of the kind described first hereinbefore which is used to make a non-woven fabric the object set forth is accomplished in accordance with the invention in that the air inlet openings are provided as air-entraining injector nozzles, which are directed to the collecting surface and discharge air streams which are parallel to said boundary walls.

Owing to the conditions of flow in the discharge ducts, the entrained air streams flowing through the injector nozzles are parallel to the boundary walls of the ejecting ducts and impart an additional acceleration to the fibers which enter said air streams and prevent a deposition of the fibers on said boundary walls. This will result in a uniform deposition of fibers on the collecting surface throughout the width of the non-woven fabric because the injector nozzles extend over the length of the boundary walls. This will permit the making of non-woven fabrics which are relatively wide so that carding drums which are relatively large in diameter are required and a uniform distribution of fibers throughout the area of the non-woven fabric can be achieved in the making of such wide non-woven fabrics.

It will be understood that the injector nozzles must not disturb the streams of fibers in the discharge ducts. For this reason each injector nozzle is desirably formed between a lower wall portion, which is inclined away from the opposite boundary wall, and an upper wall portion, which overlaps said lower wall portion on the inside, so that the nozzle will have no parts which protrude into the discharge duct and could produce in the entraining air stream a turbulence by which a uniform deposition of fibers would adversely be affected. A substantially laminar flow of air is desired in each discharge duct.

DETAILED DESCRIPTION OF THE PREFERRED EMBODIMENT

Figure 1:
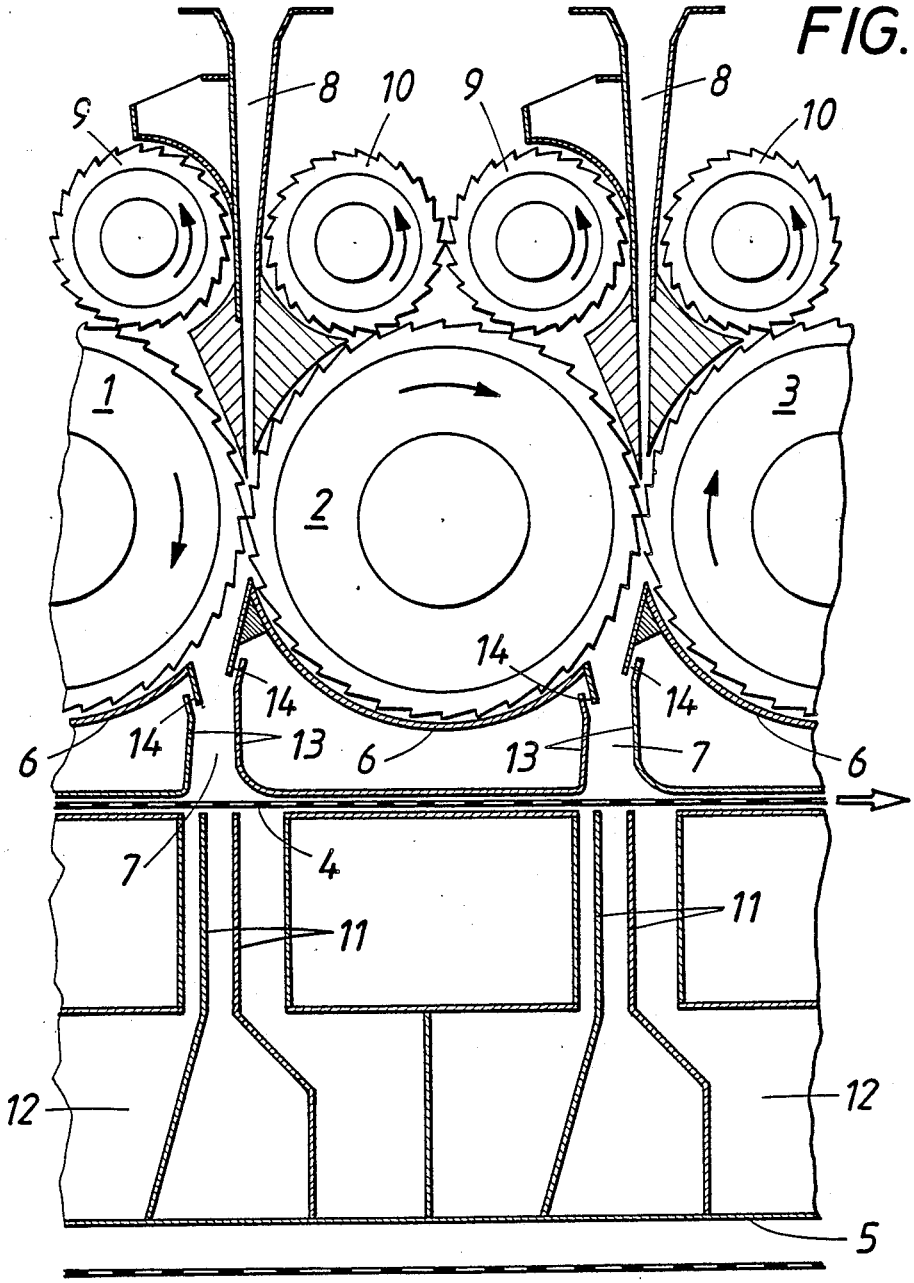
FIG. 1 is a diagrammatic vertical sectional view showing portions of an apparatus in accordance with the invention for making a non-woven fabric.

An embodiment of the invention will now be described in more detail with reference to the drawing.

In the apparatus which is illustrated, a preliminary web is fed to a plurality of closely succeeding carding drums by a feeder, which in the conventional manner consists of a feed roller and a trough-shaped deck. Three of the carding drums, which rotate in the same sense, are shown and are designated 1, 2, and 3. A collecting surface 4 extends under said carding drums 1, 2, 3 and is constituted by a revolving air-permeable conveying belt, to which suction is applied by a suction box 5. Each of the carding drums 1, 2, and 3 is provided with a cover 6 on the side which faces the collecting surface 4. Discharge ducts 7 are formed between adjacent ones of said covers 6 and extend each into the generally triangular space which is provided between adjacent carding drums on the side which faces the collecting surface 4.

To ensure that the velocity of the air flowing in the discharge ducts 7 can be matched to the velocity at which the fibers are thrown off from the carding drums 1, 2 and 3 and that the fibers will be entrained by an air stream as the fibers separate from each carding drum, blast nozzles 8 are provided on that side of the carding drums 1, 2, and 3 which is opposite to the collecting surface 4 and discharge air which flows through the throats between adjacent carding drums into the discharge ducts 7.

Because the carding drums 1, 2 and 3 closely succeed each other, each succeeding carding drum cooperates as a worker roller with the preceding carding drum. As a result, part of the fibers of the preliminary web which has been fed to the carding drum 1 is combed out by the carding drum 2, which rotates in the same sense as the carding drum 1, and that fibrous material which has not been combed out by the carding drum 2 is thrown off into the discharge duct 7 between the carding drums 1 and 2 and is deposited on the collecting surface 4 under the action of an entraining air stream, which is sucked off through the collecting surface 4. Adjacent to the carding drum 3, the fibrous material which is conveyed further by the carding drum 2 is once more divided into a partial stream that is to be thrown off and a partial stream which is to be conveyed further by the drum 3. The latter partial stream of fibers may be divided again by an additional carding drum. In that manner, a nonwoven fabric may be formed by a deposition of a plurality of partial streams of fibers, each of which has a low fiber density.

In order to increase the disintegration of the preliminary web, each of the carding drums 1, 2 and 3 has a worker roller 9 and a clearer roller 10 associated with it on that side of its periphery which is remote from the collecting surface 4. The worker roller 9 combs out part of the fibers which cover the carding drum. The fibers which have been combed out by the worker roller 9 are taken over and returned to the carding drum by the clearer roller 10. As a result, the fibrous material on each preceding carding drum will be disintegrated before said material is combed out by the succeeding carding drum and any irregularities in the distribution of fibers will be alleviated in that operation.

The deposition of fibers on the collecting surface 4 depends, inter alia, on the distribution of the air stream adjacent to the mouth of each discharge duct 7. In order to ensure desirable distribution conditions in said region, a guide wall 11 is provided adjacent to each discharge duct 7 on that side of the belt forming the collecting surface 4 which is remote from the carding drums 1, 2, 3. By said guide walls 11, the suction box section 12 which is associated with each discharge duct 7 is divided into separate flow passages, as is indicated in FIG. 1.

A formation of lumps by the fibers which have been thrown off by the carding drums 1, 2 and 3 and a deposition of fibers on the boundary walls 13 extending in the longitudinal direction of the drums should be inhibited. To that end, air inley openings consisting of air-entraining injector nozzles 14 directed toward the collecting surface 4 are provided adjacent to said boundary walls 13 between the covers 6. Said injector nozzles 14 extend throughout the length of the boundary walls 13 and each nozzle 14 discharges an air stream which is parallel to the adjacent boundary wall 13, as is indicated by the arrows 15 in FIG. 2. Said air stream flowing from the injector nozzles 14 along the boundary walls 13 will accelerate any fiber which enters such air streams and will thus inhibit the tendency, which is higher adjacent to the boundary walls, of the fibers to form lumps. That air stream which is parallel to the boundary wall will also prevent a deposition of the fibers, which may be electrostatically charged, on the boundary wall so that an undisturbed deposition of fibers on the collecting surface can actuactually be ensured. But this will be possible only if the presence of an air inley opening adjacent to a boundary wall 13 will not result in an air stream which would subject the fibers to a turbulence which would adversely affect the deposition of fibers. For this reason, properly directed air-entraining injector nozzles 14 are required which have a comparatively narrow discharge opening. In general, the width of said discharge openings should not exceed 1 to 2 mm.

Figure 2:
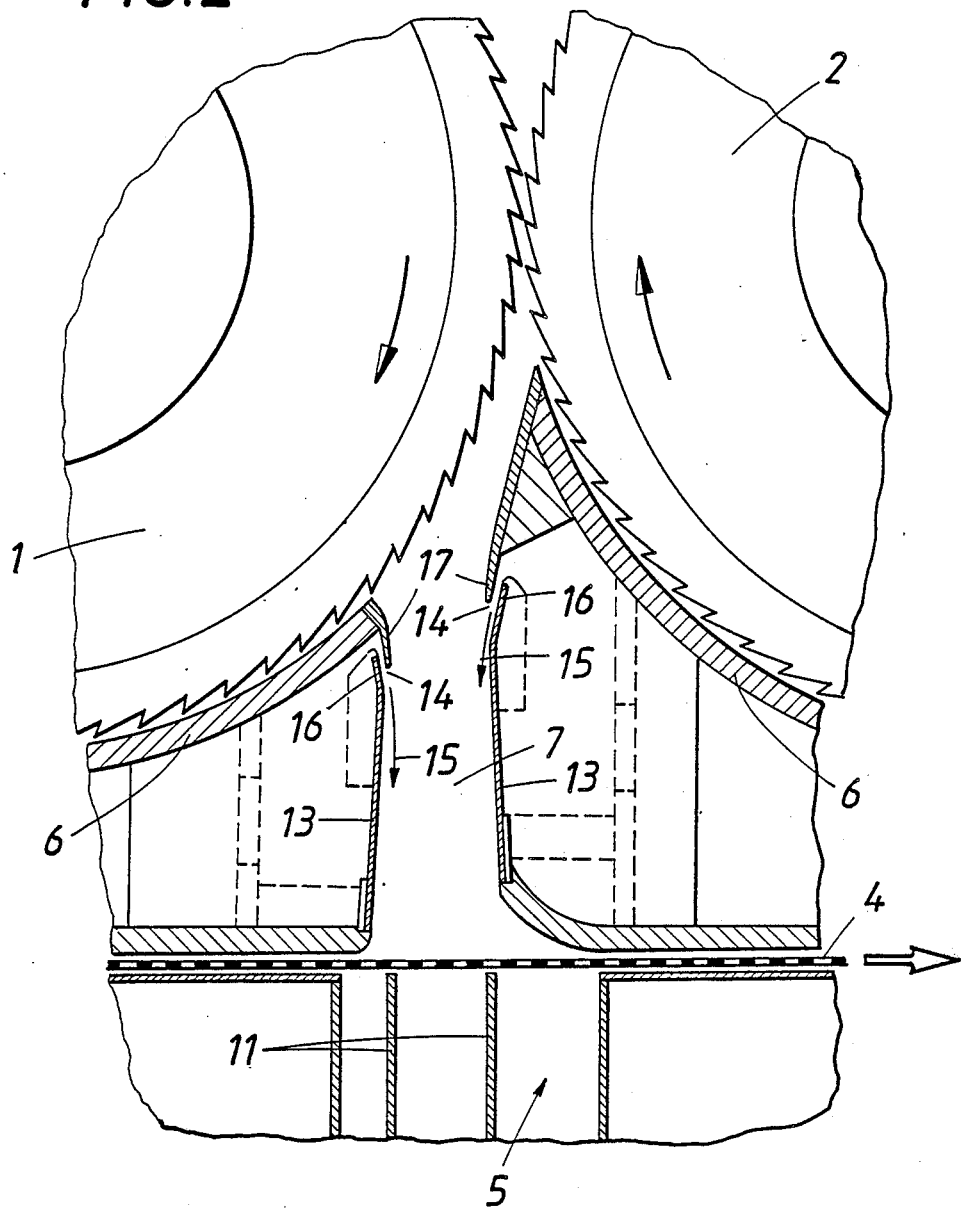
FIG. 2 is a vertical sectional view showing on a larger scale a discharge duct of said apparatus.

A particularly desirable design will be obtained if each injector nozzle 14 is constituted by a lower wall portion 16, which is inclined away from the opposite boundary surface 13 of the discharge duct 7, and an upper wall portion 17, which overlaps said lower wall portion 16 on the inside, as is particularly apparent from FIG. 2.

I claim:

1. In an apparatus for making a non-woven fabric from a preliminary web moving in a predetermined direction of travel, comprising a plurality of tooth-carrying carding drums, which are juxtaposed and closely spaced apart in said direction of travel and are operable to rotate in the same sense, wherein each of said carding drums which succeeds another in said direction of travel is arranged to cooperate as a worker roller with said other carding drum, and each of said carding drums is adapted to throw off fibers in the form of a stream of fibers under centrifugal force, air-permeable means, which is operable to move continuously in said direction of travel and have a collecting surface facing said carding drums, wherein adjacent ones of said carding drums define on the side facing said collecting surface a generally triangular space for receiving one of said streams of fibers, a plurality of discharge ducts extend in respective ones of said generally triangular spaces and are open to said collecting surface and arranged to receive respective ones of said streams of fibers and to deliver them to said collecting surface, each of said discharge ducts comprises two boundary walls, which extend in the axial direction of said drums at least one of which is formed at least one air inlet opening that extends throughout the length of said wall and adapted to admit air to said discharge duct, and suction means are provided for sucking air through said air-permeable means at least adjacent to said discharge ducts to that side of said air-permeable means which is opposite to said collecting surface so that said fibers delivered to said collecting surface are retained thereon, the improvement comprising each of said air inlet openings is defined by an air-entraining injector nozzle, arranged to discharge an air stream parallel to said baoundary wall fo said discharge dust, locaed between the cooperating drums and the air-permeable means and flows in each discharge duct toward said collecting surface.

2. The improvement set forth in claim 1, wherein each of said boundary walls comprises a lower wall portion inclined away from the other of said two boundary walls and an upper wall portion overlapping said lower wall portion on the inside thereof and together with said lower wall portion defining said air inlet opening.

* * * * *